US006571803B1

(12) United States Patent
Bregeard

(10) Patent No.: US 6,571,803 B1
(45) Date of Patent: Jun. 3, 2003

(54) METHOD FOR GUMMING A RECONSTITUTED TOBACCO LEAF

(75) Inventor: Etienne Bregeard, Canohes (FR)

(73) Assignee: Bollore (FR)

( * ) Notice: Subject to any disclaimer, the term of this patent is extended or adjusted under 35 U.S.C. 154(b) by 0 days.

(21) Appl. No.: 09/600,326

(22) PCT Filed: Nov. 9, 1999

(86) PCT No.: PCT/FR99/02741

§ 371 (c)(1),
(2), (4) Date: Jul. 10, 2000

(87) PCT Pub. No.: WO00/27230

PCT Pub. Date: May 18, 2000

(30) Foreign Application Priority Data

Nov. 9, 1998 (FR) ..... 98 14066

(51) Int. Cl.[7] ..... A24B 15/12

(52) U.S. Cl. ..... 131/370; 131/358; 131/374; 131/353; 131/365; 131/360

(58) Field of Search ..... 131/360, 365, 131/353, 358, 370, 374; 162/139

(56) References Cited

U.S. PATENT DOCUMENTS

| | | | |
|---|---|---|---|
| 4,104,431 | A | 8/1978 | Luke |
| 5,632,287 | A | 5/1997 | Hayworth et al. |
| 5,762,074 | A | 6/1998 | Garner |

FOREIGN PATENT DOCUMENTS

| | | |
|---|---|---|
| EP | 0 567 891 A1 | 3/1993 |
| FR | 97 15845 | 12/1997 |

*Primary Examiner*—Steven P. Griffin
*Assistant Examiner*—Dionne A. Walls
(74) *Attorney, Agent, or Firm*—Blakely, Sokoloff, Taylor & Zafman

(57) ABSTRACT

The present invention relates to a reconstituted tobacco leaf coated with a stripe of adhesive along one of its margins, the linear mass of the stripe of adhesive being greater than 70 mg/m in the dry state. The invention also provides a method of depositing such a stripe, and apparatus for depositing such a stripe of adhesive.

16 Claims, No Drawings

METHOD FOR GUMMING A RECONSTITUTED TOBACCO LEAF

The present invention relates to the field of smokers' articles.

More precisely the invention relates to the field of such articles using at least one reconstituted tobacco leaf.

Proposals are made in French patent application FR-97/15845 in the name of the Applicant, for an article enabling consumers to prepare their own cigarillos, said article comprising in particular a set of reconstituted tobacco leaves that are interleaved in such a manner as to enable them to be dispensed automatically by pulling on the various leaves in succession.

In such an article, each reconstituted tobacco leaf, also referred to as a "tobacco leaf" has a stripe of adhesive applied to one of its margins. Once the stripe of adhesive has dried, the leaves are interleaved.

The stripe of adhesive makes it possible, once a leaf has been rolled up, to stick down its margin on the roll formed in this way. The adhesives used for this purpose include, in particular, food grade adhesives enabling the user to stick down the margin with the help of saliva.

With leaves that have been coated with a stripe of food grade adhesive, the adhesive used can either be a cold adhesive deposited at ambient temperature and dried by convection, or a hot adhesive, e.g. a natural gum arabic or a synthetic adhesive that is deposited while hot and is dried by radiation (of the infrared type) that is localized in register with the stripe of adhesive, or else is dried in a convective oven.

The techniques presently used for putting such stripes of adhesive into place are not satisfactory.

In particular, it turns out that the tobacco leaf absorbs the gum to such an extent that the leaf with its stripe of gum has adhesive properties that are poor.

Previously proposed leaves with their stripes of adhesive enable only particularly fragile cigarillos to be made.

A main object of the invention is to propose a reconstituted tobacco leaf where the stripe of adhesive lining one of its margins enables said margin to be secured in satisfactory manner to the remainder of the leaf.

In the context of the present invention, this object is achieved by a reconstituted tobacco leaf coated with a stripe of adhesive along one of its margins, the leaf being characterized in that the linear mass of the stripe of adhesive in the dry state is greater than 70 milligrams per meter (mg/m).

In another aspect, the invention provides a method of applying such a stripe of adhesive on a reconstituted tobacco leaf, whereby the tobacco leaf conserves a certain amount of elasticity after the stripe of adhesive has been put into place. In known methods for applying a stripe of adhesive, the stripe of adhesive is dried in a manner that also leads to the leaf drying and thus becoming brittle. The leaf loses so much strength that it becomes practically impossible to use the leaf to make a smokers' article in which it needs to be tightly curved.

A method of the invention for applying a stripe of adhesive is a method in which the adhesive is dried by heating the leaf carrying the stripe, and in which the moisture content of the leaf is maintained during drying at greater than 7%.

In a third aspect of the invention, an apparatus is provided for implementing such a method, the apparatus consisting in an oven provided with means for moving the leaves in translation, said means passing through the oven, and having means for spraying water on entry into the oven and at least one air-blowing nozzle which is disposed so as to blow air on the stripe of adhesive.

Other characteristics, objects, and advantages of the present invention will appear on reading the following detailed description.

The gums that have been proposed in the past for tobacco leaves are substantially the same as those used on conventional cigarette paper. Unfortunately, those gums have been found to be difficult to use in this particular application since they adhere particularly weakly to tobacco leaves.

In addition, it is conventional to deposit a stripe of gum on a tobacco leaf with a linear mass of gum lying in the range about 40 mg/m to 50 mg/m, where such a quantity of adhesive is considered as being a particularly high quantity.

In order to dry such a quantity of adhesive, it is already necessary to subject the leaves to heating that makes them particularly brittle.

A reconstituted tobacco leaf is particularly sensitive to variations in moisture content, and in particular, when gum is applied thereto, drying the gum by means of heat causes the moisture content of the reconstituted tobacco to drop from 14% to about 4%, which has the effect of making the leaf brittle to such an extent that it is no longer possible, in practice, to handle it without leading to a large number of breaks.

In addition, if the amount of drying applied to the leaf is reduced, then a first effect is that the gum is dried incompletely, even though the leaf is still made most inconveniently brittle.

The fact of the gum being incompletely dried gives rise to untimely sticking while the leaf is being rolled up, or during subsequent handling thereof, with this problem being in addition to the leaf being brittle. In particular, it then becomes practically impossible to perform an interleaving operation.

Starting from this situation, the person skilled in the art of reconstituted tobacco leaves has not attempted to increase the quantity of adhesive in the stripe, since any such increase, even if only very slight, has been perceived as giving rise only to disadvantages.

Surprisingly, the inventors have found that when the linear mass of the stripe of adhesive in the dry state exceeds about 70 mg/m, then it presents adhesive properties that are particularly effective, and with a quantity of adhesive greater than that it is possible to make a dry stripe without causing the leaf to become unusually brittle during drying.

In preferred manner, in terms of mechanical strength, the tobacco leaf is provided with a stripe of gum whose linear weight lies in the range 80 mg/m to 100 mg/m in the dry state, with a strength and an ease of implementation effect that is particularly surprising in the range 90 mg/m to 95 mg/m in the dry state. The term "mass in the dry state" means the mass of adhesive after drying, or the mass of dry extract of adhesive.

To produce satisfactory drying of such a stripe while avoiding the previously observed effect of the leaf becoming brittle, the stripe is dried in an oven provided with strips for spraying demineralized water inside the oven. In the embodiment described herein, the stripe of adhesive is deposited immediately before the reconstituted tobacco leaf enters the oven.

In this case, the oven is a convective oven provided with means for driving the leaves that pass through it. The length of the oven lies in the range about 10 meters (m) to 15 m. It is provided with an inlet spray strip and with a spray strip located substantially in the middle of the oven.

These spray strips enable the leaf to be maintained sufficiently moist throughout the operation of gumming and in particular of drying.

Thus, during those operations taken together, and in particular during treatment in the oven, the leaf is maintained so that its moisture content lies in the range 12% to 14%.

With moisture content being maintained in this range, the gummed leaf at the outlet from the oven has moisture content of about 8% to 10%.

These moisture conditions have been identified as being optimal in terms of enabling the leaf to be handled subsequently without excessive loss of tobacco leaf due to breaking.

More generally, in accordance with the invention, care is taken to maintain the leaf at adequate moisture content during the gumming operation, and preferably at moisture content greater than 7%.

One or more strips for delivering compressed air are located at the outlet from the oven to form nozzles that are directed onto the stripes of gum.

These arrangements are particularly effective in drying the gum without drying the leaf, and in particular in drying any excess gum.

In conventional manner, the ovens used for drying the gum placed on the tobacco leaves are maintained at a temperature lying in the range 120° C. to 140° C.

Likewise in conventional manner, the gum is deposited on the leaf and the leaf is transported through the oven during drying at a "gumming" speed which lies in the range 60 meters per minute (m/min) to 80 m/min.

The inventors have been able to determine an oven temperature that is particularly suitable for effective drying of the gum while enabling the moisture content of the tobacco leaf to be maintained within the above-specified ranges.

Thus, in accordance with the invention, an oven temperature is used that is selected to lie approximately in the range 70° C. to 90° C., and a gumming speed is selected that lies approximately in the range 18 m/min to 20 m/min. For the 15 m oven used in this case, this travel speed corresponds to an optimum drying time under heating of about 45 seconds (s). More generally, the ideal drying time lies in the range 30 s to 1 min.

By means of these dispositions, the resulting gummed tobacco leaf at the outlet from the oven presents moisture content lying in the range 8% to 10% and it has a stripe of gum that is completely dry.

These conditions are optimal for moving on to the interleaving operation when a dispenser is provided having interleaved leaves.

Naturally, these conditions are described with reference to a convective oven, however it would also be possible to adapt them for use in a radiant oven. Under such circumstances, an oven should be used having a length of approximately 2 m to 4 m.

In the present method, on leaving the oven, the tobacco leaf is stored on bobbins. The bobbins are then protected from evaporation by being wrapped in an impermeable plastics film or in any other leakproof covering.

Preferably, and in accordance with the invention, the moisture content of the tobacco leaf is also controlled during the interleaving operation.

For this purpose, strips for spraying demineralized water are installed at the inlet to apparatus for performing interleaving.

Naturally, the above-described dispositions are not limited to making a smokers' article having interleaved leaves.

The tobacco leaf and the methods described herein can be applied to making any other smokers' article within the ambit of the invention.

What is claimed is:

1. A reconstituted tobacco leaf coated with a stripe of adhesive along one of its margins, the leaf being characterized in that the linear mass of the stripe of adhesive in the dry state is greater than 70 mg/m.

2. A reconstituted tobacco leaf according to claim 1, characterized in that the linear mass of the stripe of adhesive in the dry state is greater than 80 mg/m.

3. A reconstituted tobacco leaf according to claim 1 or 2, characterized in that the linear mass of the stripe of adhesive in the dry state is greater than 90 mg/m.

4. A reconstituted tobacco leaf according to claim 1 or 2, characterized in that the linear mass of the stripe of adhesive in the dry state lies in the range 90 mg/m and about 95 mg/m.

5. A method of applying a stripe of adhesive along a margin of a reconstituted tobacco leaf characterized in that the stripe is applied in such a quantity that the linear mass of the stripe of adhesive in the dry state is greater than 70 mg/m.

6. A method according to claim 5, further comprising drying the leaf wherein the moisture content of the leaf is maintained during the drying in the range 12% to 14%.

7. The method of claim 5, characterized in that the adhesive is dried by heating the leaf provided with the stripe of adhesive, and in that the moisture content of the leaf is maintained during drying at more than 7%.

8. A method according to any one of claim 5, 6 or 7 characterized in that the stripe of adhesive is deposited on the leaf at a deposition speed of about 18 meters per minute to 20 meters per minute.

9. The method according to claim 5, 6 or 7 characterized in that the method is carried out with an oven which is provided with means for moving the reconstituted tobacco leaves that pass through the oven in translation, means for spraying water at the entrance to the oven, and at least one nozzle blowing air that is located to blow on the stripe of adhesive.

10. A method according to claim 6 or 7, characterized in that the duration of drying lies in the range 30 seconds to 1 minute.

11. A method according to any one of claim 6 or 7 characterized in that drying is performed by drying the leaf in an oven, and in that moisture content is maintained by spraying water inside the oven.

12. A method according to claim 11, characterized in that the temperature of the oven is selected to lie in the range of approximately 70° to 90° C.

13. A method according to any one of claim 6 or 7 characterized in that compressed air is blown onto the stripe of adhesive during drying.

14. A method of making a smokers' article comprising a set of reconstituted tobacco leaves, the leaves being interleaved so as to enable them to be dispensed automatically by pulling on the various leaves in succession, the article comprising a container-dispenser suitable for receiving said set of interleaved leaves and for controlling the dispensing thereof, the method being characterized in that a stripe of adhesive is applied along a margin of each tobacco leaf before the leaves are interleaved, in such a quantity that the linear mass of each stripe is greater then 70 mg/m.

15. A method according to claim 14 further comprising drying the leaves, characterized in that the leaves are maintained in a leakproof covering between an end of the drying and a beginning of the interleaving.

16. The method of claim 14 characterized in that water is sprayed on a leaf prior to interleaving the leaf with the other leaves.

* * * * *